United States Patent [19]

Grover

[11] Patent Number: 4,466,894

[45] Date of Patent: Aug. 21, 1984

[54] PHOSPHORUS-CONTAINING METAL SALTS/SULFURIZED PHENATE COMPOSITIONS/AROMATIC SUBSTITUTED TRIAZOLES, CONCENTRATES, AND FUNCTIONAL FLUIDS CONTAINING SAME

[75] Inventor: Kent B. Grover, Chardon, Ohio

[73] Assignee: The Lubrizol Corporation, Wickliffe, Ohio

[21] Appl. No.: 486,640

[22] Filed: Apr. 20, 1983

[51] Int. Cl.[3] ..... C10M 1/48

[52] U.S. Cl. ..... 252/32.7 E; 252/35; 252/38; 252/42.7; 252/46.7; 252/50; 252/400 A; 252/405; 252/406

[58] Field of Search ..... 252/32.7 E, 35, 38, 252/46.7, 42.7, 400

[56] References Cited

U.S. PATENT DOCUMENTS

| | | | |
|---|---|---|---|
| 3,926,823 | 12/1975 | Durr et al. | 252/50 |
| 3,969,237 | 7/1976 | Andress, Jr. | 252/32.5 |
| 4,417,990 | 11/1983 | Clason et al. | 252/32.7 E |

*Primary Examiner*—Jacqueline V. Howard

*Attorney, Agent, or Firm*—Denis A. Polyn; Raymond F. Keller

[57] ABSTRACT

A composition comprising (A) at least one metal salt of a mixture of acids comprising (A)(I) at least one acid of Formula I

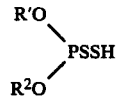

I wherein R' and $R^2$ are the same or different and each of R' and $R^2$ is a hydrocarbon-based group, and (A)(II) at least one aliphatic or alicyclic carboxylic acid containing from about 2 to about 40 carbon atoms, (B) at least one sulfurized Group II metal phenate, and (C) a stabilizing amount of at least one triazole selected from the group consisting of benzotriazole and alkyl substituted benzotriazoles containing up to 15 carbon atoms in the alkyl group.

33 Claims, No Drawings

PHOSPHORUS-CONTAINING METAL SALTS/SULFURIZED PHENATE COMPOSITIONS/AROMATIC SUBSTITUTED TRIAZOLES, CONCENTRATES, AND FUNCTIONAL FLUIDS CONTAINING SAME

TECHNICAL FIELD

This invention relates to compositions which are useful in preparing additive concentrates and functional fluids, and to the concentrates and functional fluids containing said additive compositions. More particularly, this invention relates to compositions comprising (A) at least one metal salt of a mixture of acids comprising phosphorus acids and aliphatic or alicyclic carboxylic acids, (B) at least one sulfurized Group II metal phenate, and (C) at least one triazole selected from the group consisting of benzotriazole and alkyl-substituted benzotriazole containing up to about 15 carbon atoms in the alkyl group. This invention also relates to additive concentrates and functional fluids which are prepared utilizing the above-described compositions of the invention.

BACKGROUND OF THE INVENTION

The use of metal salts, especially zinc salts, of phosphorodithioic acids as antioxidants and extreme pressure agents in lubricants and functional fluids has been known for some time. However, the environment in which said lubricants and functional fluids are used has become increasingly severe over recent years with the further development of machinery employing such lubricants and functional fluids. It is important, therefore, that materials of this type be developed which have higher thermal and hydrolytic stability than has previously been the case.

The use of sulfurized calcium alkyl phenates as compounding agents in lubricating oils to inhibit corrosion, piston ring sticking and gum formation in internal combustion engines resulting from oxidation of lubricating oil and polymerization of engine fuel residues is also known, as indicated in U.S. Pat. Nos. 2,680,096 and 3,036,971.

Metal salts of mixtures of phosphorodithioic acids and carboxylic acids have been described as being useful in lubricants and functional fluids in U.S. Pat. No. 4,308,154. In copending U.S. application Ser. No. 334,251, filed on Dec. 24, 1981, phosphorus- and sulfur-containing compositions of improved thermalstability useful in lubricants and functional fluids are described. The compositions comprise a metal salt of a mixture of a phosphorodithioic acid and an aliphatic or alicyclic carboxylic acid, and at least one sulfurized Group II metal phenate.

An improvement in the properties of salts of dialkylphosphorodithioic acids is described in U.S. Pat. No. 4,263,150 wherein the dialkylphosphorodithioic acids or their salts are treated with phosphites, especially triaryl phosphites. The products obtained by this process exhibit reduced tendency to stain and corrode metal parts, especially copper parts, when incorporated into lubricants and functional fluids. The process also is useful for treating metal salts of mixtures of dialkylphosphorodithioic acid and carboxylic acids.

SUMMARY OF THE INVENTION

Compositions useful for preparing functional fluids exhibiting improved hydrolytic stability are described which comprise (A) at least one metal salt of a mixture of acids comprising phosphorodithioic acids and carboxylic acids, (B) at least one sulfurized Group II metal phenate, and (C) at least one triazole. The invention also relates to lubricating oils and functional fluids which are prepared utilizing the concentrates.

DESCRIPTION OF THE PREFERRED EMBODIMENTS

The compositions of the present invention comprise (A) at least one metal salt of a mixture of acids comprising a phosphorus acid and a carboxylic acid, (B) at least one sulfurized Group II metal phenate, and (C) a triazole compound.

The term "hydrocarbon-based group" is used throughout this specification and in the appended claims to denote a group having a carbon atom directly attached to the remainder of the molecule and having predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, the two indicated substituents may together form a cyclic group). Such groups are known to those skilled in the art; examples include methyl, ethyl, butyl, hexyl, octyl, decyl, dodecyl, tetradecyl, octadecyl, eicosyl, cyclohexyl, phenyl and naphthyl (all isomers being included).

(2) Substituted hydrocarbon groups; that is, groups containing non-hydrocarbon substituents which, in the context of this invention, do not alter predominantly hydrocarbon character of the group. Those skilled in the art will be aware of suitable substituents (e.g., halo, hydroxy, alkoxy, carbalkoxy, nitro, alkylsulfoxy).

(3) Hetero groups; that is, groups which, while predominantly hydrocarbon in character within the the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based group.

(A) The Metal Salts:

Component (A) includes the metal salts of the Group I metals, the Group II metals, aluminum, tin, cobalt, lead, molybdenum, manganese and nickel, as well as mixtures of two or more of those metals. The preferred salts are those of zinc. As will be apparent from the foregoing, the metal salts of this invention are salts of at least two acidic components of which component (A)(I) is a phosphorodithioic acid and component (A)(II) is at least one aliphatic or alicyclic carboxylic acid. Component (A)(I) is at least one acid of the formula

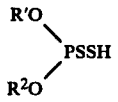

I wherein R′ and $R^2$ are the same or different, and each of R′ and $R^2$ is a hydrocarbon-based group.

The phosphorus acids can be prepared by methods well known in the art and generally are prepared by the reaction of phosphorus pentasulfide ($P_2S_5$) with an alcohol or a phenol, or a mixture of alcohols. The reaction involves mixing at a temperature of about 20° to about 200° C., four moles of the alcohol or phenol with one mole of phosphorus pentasulfide. Hydrogen sulfide is liberated in this reaction.

Preferably, the hydrocarbon-based groups in the compounds useful as component (A)(I) according to this invention are free from acetylenic and usually also from ethylenic unsaturation and have from 1 to about 50 carbon atoms, preferably 1 to about 30 carbon atoms, and more preferably from about 3 to about 18 carbon atoms. R′ and $R^2$ are most often identical, although they may be different and either or both may be mixtures. The groups are usually hydrocarbon, preferably alkyl, and most desirably branched alkyl. Examples of R′ and $R^2$ groups include isopropyl, isobutyl, 4-methyl-2-pentyl, 2-ethylhexyl, isooctyl, etc.

Component (A)(II) may be a monocarboxylic or polycarboxylic acid, usually containing from 1 to about 3 carboxy groups and preferably only 1. It may contain from about 2 to about 40, preferably from about 2 to about 20 carbon atoms, and advantageously about 5 to about 20 carbon atoms. The preferred carboxylic acids are those having the formula $R^3COOH$, wherein $R^3$ is an aliphatic or alicyclic hydrocarbon-based radical preferably free from acetylenic unsaturation. Suitable acids include the acetic, propionic, butanoic, pentanoic, hexanoic, octanoic, nonanoic, decanoic, dodecanoic, octadecanoic and eicosanoic acids, as well as olefinic acids such as acrylic, oleic, linoleic, and linoleic acids and linoleic acid dimer. For the most part, $R^3$ is a saturated aliphatic radical and especially a branched alkyl radical such as the isopropyl or 3-heptyl radical. Illustrative polycarboxylic acids are oxalic, malonic, succinic, alkyl- and alkenylsuccinic, glutaric, adipic, pimelic, sebacic, maleic, fumaric and citric acids.

Component (A) may be prepared by merely blending a metal salt of component (A)(I) with a metal salt of component (A)(II) in the desired ratio. This ratio is between about 0.5:1 and about 500:1 on an equivalent basis. Preferably, the ratio is between about 0.5:1 and about 200:1. Advantageously, the ratio of (A)(I) to (A)(II) can be from about 0.5:1 to about 100:1, preferably from about 0.5:1 to about 50:1, and more preferably from about 0.5:1 to about 20:1. Further, the ratio of (A)(I) to (A)(II) can be from about 0.5:1 to about 4.5:1, preferably about 2.5:1 to about 4.25:1. For this purpose, the equivalent weight of a phosphorodithioic acid is its molecular weight divided by the number of —PSSH groups therein, and that of a carboxylic acid is its molecular weight divided by the number of carboxy groups therein.

The information required to determine equivalents can usually be determined from the structural formula of components (A)(I) and (A)(II) or empirically through well known titration procedures. For example, a succinic acid anhydride has an equivalent weight of one-half its molecular weight. The number of equivalents of the components can be determined by dividing the weight of the component by its equivalent weight. The total number of equivalents of component (A) can be determined by adding the number of equivalents of component (A)(I) and the number of equivalents of component (A)(II).

A second and preferred method for preparing the metal salts of mixtures of acids (A)(I) and (A)(II) is to prepare a mixture of the acids (components (A)(I) and (A)(II)) in the desired ratio and to react the acid mixture with a suitable metal base. When this method of preparation is used, it is frequently possible to prepare a neutral salt or a salt containing an excess of metal with respect to the number of equivalents of acid present; thus, mixed metal salts containing as many as 2 equivalents and especially up to about 1.5 equivalents of metal per equivalent of acid may be prepared. The equivalent of a metal for this purpose is its atomic weight divided by its valence.

The term "neutral salt" refers to salts characterized by metal content equal to that which would be present according to the stoichiometry of the metal and the particular organic compound reacted with the metal, i.e., component (A)(I) or mixtures of components (A)(I) and (A)(II). Thus, if a phosphorodithioic acid, $(RO)_2PSSH$, is neutralized with a basic metal compound, e.g., zinc oxide, the neutral metal salt produced would contain one equivalent of zinc for each equivalent of acid, i.e., $[(RO)_2PSS]_2Zn$.

However, with the present invention, component (A) can contain more or less than the stoichiometric amount of metal. The products containing less than the stoichiometric amount of metal are acidic materials. The products containing more than the stoichiometric amount of metal are overbased materials. For example, salts of component (A) containing 80% of the metal present in the corresponding neutral salt are acidic, while salts of component (A) containing 110% of the metal present in the corresponding neutral salt are overbased. Component (A) may have about 80% to about 200%, preferably about 100% to about 150%, more preferably about 100% to about 135%, and advantageously about 103% to about 110% of the metal present in the corresponding neutral salt.

Variants of the above-described methods may also be used to prepare the mixed salts of this invention. For example, a metal salt of component (A)(I) or (A)(II) may be blended with the free acid as component (A)(II) or (A)(I), respectively, and the resulting blend reacted with additional metal base.

Suitable metal bases for the preparations of the metal salts (A) of this invention include the free metals previously enumerated and their oxides, hydroxides, alkoxides and basic salts. Examples are sodium hydroxide, sodium methoxide, sodium carbonate, potassium hydroxide, potassium carbonate, magnesium oxide, magnesium hydroxide, calcium hydroxide, calcium acetate, zinc oxide, zinc acetate, lead oxide, nickel oxide and the like.

The temperature at which the metal salts of this invention are prepared is generally between about 30° and about 150° C., preferably up to about 125° C. If component (A) is prepared by neutralization of a mixture of acids with a metal base, it is preferred to employ temperatures above about 50° and especially above about 75°. It is frequently advantageous to conduct the reaction in the presence of a substantially inert, normally liquid organic diluent such as naphtha, benzene, xylene, mineral oil or the like. If the diluent is mineral oil or is physically and chemically similar to mineral oil, it frequently need not be removed before using component (A) in the composition, concentrates and functional fluids of the invention.

The preparation of the metal salts useful in this invention is illustrated by the following examples. All parts and percentages are by weight.

EXAMPLE A-1

A mixture of 67 parts (1.63 equivalents) of zinc oxide and 48 parts of mineral oil is stirred at room temperature and a mixture of 401 parts (1 equivalent) of di-(2-ethylhexyl)phosphorodithioic acid and 36 parts (0.25 equivalent) of 2-ethylhexanoic acid is added over 10 minutes. The temperature increases to 40° C. during the addition. When the addition is complete, the temperature is increased to 80° C. for 3 hours. The mixture is then vacuum stripped at 100° C. to yield the desired metal salt as a 91% solution in mineral oil.

EXAMPLE A-2

Following the procedure of Example 1, a product is prepared from 383 parts (1.2 equivalents) of a dialkyl phosphorodithioic acid containing 65% isobutyl and 35% amylgroups, 43 parts (0.3 equivalent) of 2-ethylhexanoic acid, 71 parts (1.73 equivalents) of zinc oxide and 47 parts of mineral oil. The resulting metal salt, obtained as a 90% solution in mineral oil, contains 11.07% zinc.

EXAMPLE A-3

Following the procedure of Example 1, a product is prepared from 474 parts (1.2 equivalents) of a dialkylphosphorodithioic acid containing 80% 2-ethylhexyl groups and 20% isobutyl groups, 43 parts (0.3 equivalent) of 2-ethylhexanoic acid, 80 parts (1.95 equivalents) of zinc oxide and 57 parts of mineral oil. The resulting metal salt is obtained as a 91% solution in mineral oil.

EXAMPLE A-4

A mixture of 118 parts (2.8 equivalents) of zinc oxide, 25 parts (0.25 equivalent) of sebacic acid and 72 parts of mineral oil is stirred at room temperature and a mixture of 584 parts (2 equivalents) of the dialkylphos-phorodithioic acid of Example 2 and 36 parts (0.25 equivalent) of 2-ethyl-hexanoic acid is added over 30 minutes. The temperature increases to 65° C. during the addition. The solution is heated to 80° C. for 3 hours and vacuum stripped at 180° C. The residue is filtered to yield the desired metal salt (90% solution in mineral oil) containing 11.7% zinc.

EXAMPLE A-5

A product is prepared by the procedure of Example A-1 except that an equivalent amount of oleic acid is substituted for the 2-ethylhexanoic acid.

In some instances, the properties of the metal salts, component (A), can be improved by treating said salt or their acid precursors with phosphites. More particularly, the metal salts of component (A) can be contacted with at least one organic phosphite of the formula $(R^4O)_3P$, wherein each $R^4$ is independently hydrogen or a hydrocarbon-based group.

Preferably, the hydrocarbon-based groups present as $R^4$ in the phosphite compounds are free from acetylenic and usually also from ethylenic unsaturation and have from about one to about 12 carbon atoms. desirably up to about 10 carbon atoms. The groups are usually hydrocarbon and especially lower hydrocarbon, the work "lower" denoting groups containing up to 7 carbon atoms. The groups are preferably lower alkyl or aryl groups, most often lower aryl and especially phenyl.

As apparent from the definition, the phosphite may be primary, secondary or tertiary. That is, it may contain one, two or three hydrocarbon-based groups per molecule. The tertiary phosphites are preferred for use in the method of the invention.

Treatment of the metal salt component (A) with the organic phosphite is conveniently effected by merely heating the acid metal salts with the phosphite compound at a temperature typically between about 50° and about 200° C., and preferably between about 100° and about 150° C. The reaction may be carried out in a substantially inert normally liquid organic diluent such as mineral oil, xylene or the like. If the diluent is mineral oil or is physically and chemically similar to mineral oil, it frequently need not be removed before using the product in a lubricant or functional fluid. The amount of phosphite used is generally between about 2 and about 20 parts, preferably between about 2 to 10 parts by weight per 100 parts of metal salt. If the free phosphorus acid is treated with the phosphite, the weight proportions thereof are adjusted to be equivalent to the desired level of treatment of the salt.

The method of treating the metal salts of the invention with organic phosphites is illustrated by the following examples. All parts and percentages are by weight.

EXAMPLES A-6 TO A-8

Triphenyl phosphite is heated with a zinc salt of a mixture of a dialkylphosphorodithioic acid and a carboxylic acid. The dialkylphosphorodithioic acid used in the preparation of the zinc salt is itself prepared by the reaction of at least one alcohol with phosphorus pentasulfide which contains a stoichiometric excess of sulfur. The reaction conditions and results are given in Table I. The salts are prepared by reacting zinc oxide with 4 equivalents of the dialkylphosphorodithioic acid and 1 equivalent of the carboxylic acid, a total of 1.3 equivalents of zinc oxide being used per equivalent of acid. The reactions are carried out in a small amount of mineral oil as diluent.

TABLE I

| Example | $R',R^2$ | $R^3$ | % S in $P_2S_5$ | Parts $(C_6H_5O)_3P$ per 100 parts salt | Temp., °C. | Time, hrs. |
|---|---|---|---|---|---|---|
| A-6 | 2-Ethylhexyl | 3-Heptyl | 72.6 | 3.4 | 120 | 3 |
| A-7 | 2-Ethylhexyl | 3-Heptyl | 72.3–72.7 | 6.5 | 130 | 3½ |
| A-8 | 2-Ethylhexyl | 3-Heptyl | 72.3–72.7 | 7.5 | 130 | 4 |

(B) The Sulfurized Group II Metal Phenates:

The sulfurized Group II metal phenates that are included in the compositions of the present invention are preferably basic sulfurized Group II metal phenates. The phenol group of such phenates includes an aromatic moiety with at least one hydrocarbon-based radical and an oxygen atom attached to such aromatic moiety, as indicated in Formula II, below. The phenol group is sulfurized and based (or overbased) with a Group II metal, as discussed below, to form component (B). As used herein, the term "normal" sulfurized Group II metal phenates is used to refer to those phenates wherein the ratio of Group II metal to the phenol group is about 1:2, in accordance with Formula II $$(R_a\text{—Ar—O—})_2M \qquad \text{II}$$

wherein ($R_a$—Ar—O—) is the phenol group; M is a Group II metal; Ar is an aromatic moiety which is preferably benzene; R is a hydrocarbon-based radical; and a is an integer of from 1 up to the number of unsatisfied valences in Ar, preferably 1 or 2. As used herein, the term "basic" sulfurized Group II metal phenates refers to sulfurized Group II metal phenates wherein the ratio of Group II metal to the phenol group is greater than that of normal sulfurized Group II metal phenates. Such phenates are referred to interchangeably as "basic" or "overbased". Component (B) generally contains up to about 1000%, preferably up to about 500%, of the Group II metal present in the corresponding sulfurized normal Group II metal phenate. Advantageously, component (B) contains from about 250% to about 450%, preferably about 350%, of the Group II metal present in the corresponding sulfurized normal Group II metal phenate. Component (B) has a sulfur to phenol group molar ratio of from about 2:1 to about 1:2, preferably about 2:1 to about 1:1, and advantageously about 4:3. Any of the Group II metals can be used to form component (B), but calcium is preferred. Component (B) includes, for example, basic sulfurized tetrapropenyl phenate with, for example, about 230% or 380% of the calcium present in the corresponding normal calcium phenate, and a sulfur to phenol group molar ratio of about 4:3.

While the terms "phenol" and "phenate" are used herein in the description of component (B), it is to be understood that such terms are not intended to limit the aromatic moiety of the phenol group of component (B) to benzene. Accordingly, it is to be understood that the aromatic moiety of component (B), as represented by "Ar" in Formula II can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein at least one aromatic nucleus is fused at two points to another nucleus such as found in naphthalene, anthracene, the azanaphthalenes, etc. Alternatively, such polynuclear aromatic moieties can be of the linked type wherein at least two nuclei (either mono- or polynuclear) are linked through bridging linkages to each other. Such bridging linkages can be chosen from the group consisting of carbon-to-carbon single bonds, ether linkages, keto linkages, sulfide linkages, polysulfide linkages of 2 to 6 sulfur atoms, sulfinyl linkages, sulfonyl linkages, methylene linkages, alkylene linkages, di-(lower alkyl)-methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorene nucleus has two benzene nuclei linked by both a methylene linkage and a covalent bond. Such a nucleus may be considered to have 3 nuclei but only two of them are aromatic. Normally, however, Ar will contain only carbon atoms in the aromatic nuclei per se (plus any lower alkyl or alkoxy substituent present).

The number of aromatic nuclei, fused, linked or both, in Ar can play a role in determining the integer values of a in Formula II. For example, when Ar contains a single aromatic nucleus, a, is from 1 to 5. When Ar contains two aromatic nuclei, a can be an integer of 1 to 10. With a tri-nuclear Ar moiety, a can be an integer of 1 to 15. The value of a is obviously limited by the fact that it cannot exceed the total unsatisfied valences of Ar.

The single ring aromatic nucleus which can be the Ar moiety can be represented by the general formula $$ar(Q)_m$$

wherein ar represents a single ring aromatic nucleus (e.g., benzene) of 4 to 10 carbons, each Q independently represents a lower alkyl group, lower alkoxy group, nitro group, or halogen atom, and m is 0 to 3. As used in this specification and appended claims, "lower" refers to groups having 7 or less carbon atoms such as lower alkyl and lower alkoxyl groups. Halogen atoms include fluorine and chlorine atoms.

Specific examples of single ring Ar moieties are the following:

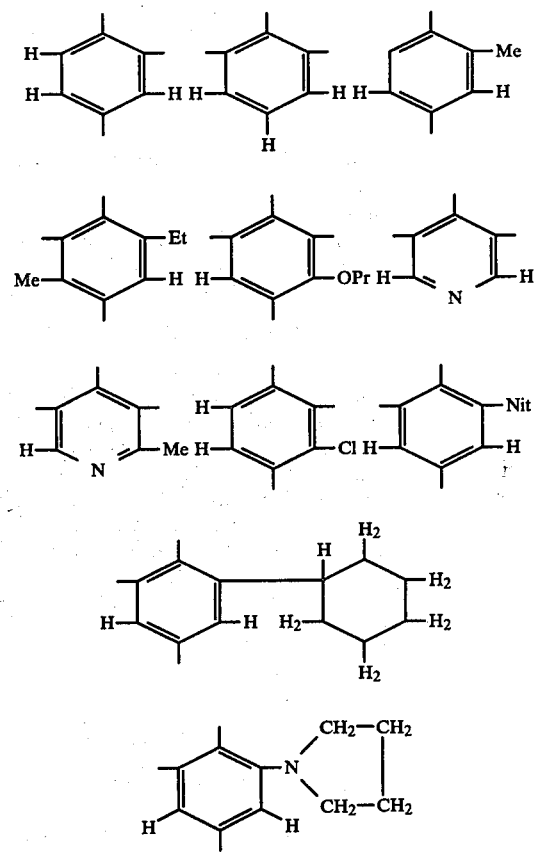

wherein Me is methyl, Et is ethyl, Pr is n-propyl, and Nit is nitro.

When Ar is a polynuclear fused-ring aromatic moiety, it can be represented by the general formula $Ar\langle ar\rangle_{m'}(Q)_{mm'}$ wherein Ar, Q and m are as defined hereinabove, m' is 1 to 4 and ⌒ represent a pair of fusing bonds fusing two rings so as to make two carbon atoms part of the rings of each of two adjacent rings. Specific examples of fused ring aromatic moieties Ar are:

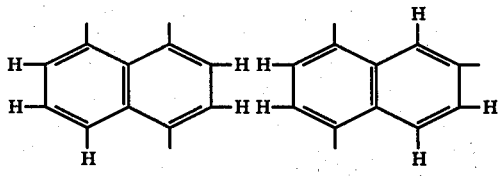

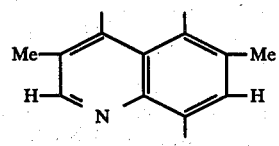

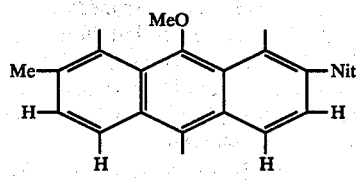

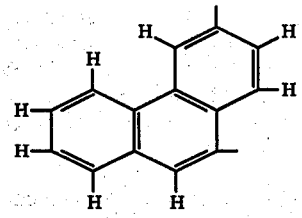

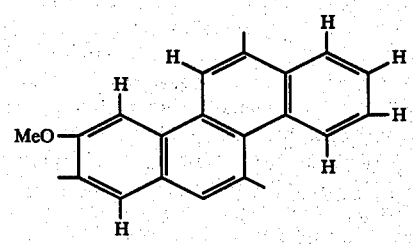

When the aromatic moiety Ar is a linked polynuclear aromatic moiety it can be represented by the general formula $ar\text{-}(Lng\text{-}ar)_w(Q)_{mw}$ wherein w is an integer of 1 to about 20, ar is as described above with the proviso that there are at least 2 unsatisfied (i.e., free) valences in the total of ar groups, Q and m are as defined hereinbefore, and each Lng is a bridging linkage individually chosen from the group consisting of carbon-to-carbon single bonds, ether linkages (e.g. —O—), keto linkages (e.g., $-\overset{O}{\overset{\|}{C}}-$), sulfide linkages (e.g., —S—), polysulfide linkages of 2 to 6 sulfur atoms (e.g., $-S_{2-6}-$), sulfinyl linkages (e.g., —S(O)—), sulfonyl linkages (e.g., $-S(O)_2-$), lower alkylene linkages (e.g., $-CH_2-,\ -CH_2-CH_2-,\ -CH-\underset{R^\circ}{\underset{|}{C}}H-,$ etc.), di(lower alkyl)-methylene linkages (e.g., $CR^\circ{}_2-$), lower alkylene ether linkages (e.g., $-CH_2O-,\ -CH_2O-CH_2-,\ -CH_2-CH_2-O-,$ $-CH_2CH_2OCH_2CH_2-,\ -CH_2\underset{R^\circ}{\underset{|}{C}}HOCH_2\underset{R^\circ}{\underset{|}{C}}H-$ $-CH_2\underset{R^\circ}{\underset{|}{C}}HO\underset{R^\circ}{\underset{|}{C}}HCH_2-,$ etc.), lower alkylene sulfide linkages (e.g., wherein one or more —O—'s in the lower alkylene ether linkages is replaced with an —S— atom), lower alkylene polysulfide linkages (e.g., wherein one or more —O—'s is replaced with a $-S_{2-6}$ group), amino linkages (e.g., $-\underset{H}{\underset{|}{N}}-,\ -\underset{R^\circ}{\underset{|}{N}}-,\ -CH_2N-,\ -CH_2NCH_2-,\ -alk\text{-}N-,$ where alk is lower alkylene, etc.), polyamino linkages (e.g., $-\underset{|}{N}(alk\underset{|}{N})_{1-10}$ where the unsatisfied free N valences are taken up with H atoms or R° groups), and mixtures of such bridging linkages (each R° being alower alkyl group). It is also possible that one or more of the ar groups in the above-linked aromatic moiety can be replaced by fused nuclei such as $ar\langle ar\rangle_{m'}.$ Specific examples of linked moieties are:

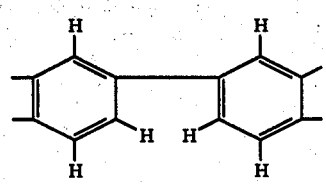

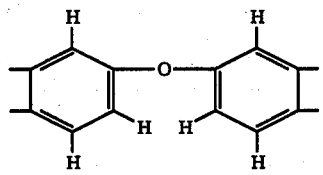

-continued

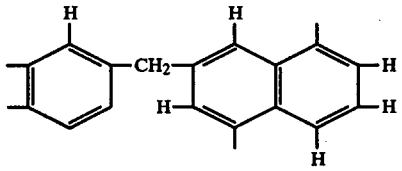

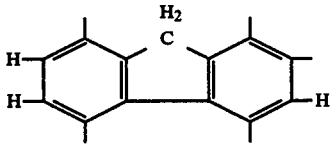

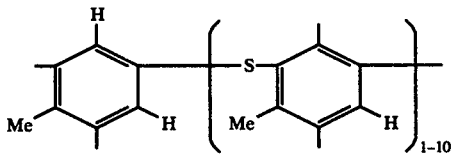

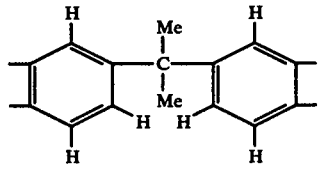

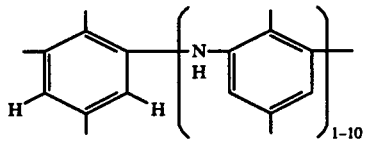

Usually all these Ar moieties are unsubstituted except for the R and —O— groups (and any bridging groups).

For such reasons as cost, availability, performance, etc., the Ar moiety is normally a benzene nucleus, lower alkylene bridged benzene nucleus, or a naphthalene nucleus.

As indicated in Formula II, component (B) includes R, a hydrocarbon-based group, directly bonded to the aromatic moiety Ar. Hydrocarbon-based group R is defined above and contains about 6 to about 80 carbon atoms, preferably about 6 to about 30 carbons, more preferably about 8 to about 25 carbon atoms, and advantageously about 8 to about 15 carbon atoms. Examples of such hydrocarbon-based groups R include tetrapropenyl and tri(isobutene). The attachment of the hydrocarbon-based group R to the aromatic moiety Ar of component (B) of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol. The reaction occurs in the presence of a Lewis acid catalyst (e.g., boron trifluoride and its complexes with ethers, phenols, hydrogen fluoride, etc., aluminum chloride, aluminum bromide, zinc dichloride, etc.). Methods and conditions for carrying out such reactions are well known to those skilled in the art. See, for example, the discussion in the article entitled, "Alkylation of Phenols" in "Kirk-Othmer Encyclopedia of Chemical Technology", Second Edition, Vol. 1, pages 894–895, Interscience Publishers, a division of John Wiley and Company, N.Y., 1963. Other equally appropriate and convenient techniques for attaching the hydrocarbon-based group R to the aromatic moiety Ar will occur readily to those skilled in the art.

As will be appreciated from inspection of Formula II the phenol group of component (B) of this invention contains at least one R group as defined above, and —O—. Each of the foregoing must be attached to a carbon atom which is a part of an aromatic nucleus in the Ar moiety. They need not, however, each be attached to the same aromatic ring if more than one aromatic nucleus is present in the Ar moiety.

The preparation of component (B) can be accomplished by any of the standard techniques known to those skilled in the art for producing basic sulfurized Group II metal phenates. These techniques include, for example, one-step processes wherein sulfurization and basing (or overbasing) with the Group II metal are effected simultaneously, and two-step processes wherein the phenol is first sulfurized, then based. Each of these techniques are well known to those skilled in the art and, accordingly, need not be further discussed herein. The source of sulfur is generally elemental sulfur, or sulfur halide, for example, $SCl_2$ or $S_2Cl_2$. Examples of patents disclosing suitable procedures for preparing component (B) include U.S. Pat. Nos. 2,680,096; 3,036,971; 3,178,368; 3,437,595; and Re 29,661, these patents being incorporated herein by reference.

The amount of component (B) included in the composition of this invention may vary over a wide range. Generally, the weight ratio of component (A) to component (B) is in the range of 40:1 to about 1:2, preferably about 20:1 to 1:1, and advantageously about 15:1 to 5:1. When the compositions of the invention are used in lubricants, a preferred ratio of (A) to (B) to about 1:1. On the other hand, when these compositions are used in functional fluids, such as a hydraulic fluid, a preferred ratio of (A) to (B) is about 14:1.

(C) The Triazole:

The triazole used in the method of this invention may be benzotriazole and alkyl-substituted benzotriazole. The alkyl substituent generally contains up to 15 carbon atoms, preferably up to 8 carbon atoms. In addition to the alkyl substituent, the triazoles may contain other substituents on the aromatic ring such as halogens and nitro groups. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole are particularly preferred.

The amount of triazole included in the composition generally is less than 5% by weight. When the composition of the invention is to be used in a functional fluid such as a hydraulic fluid, only small amounts of the triazole compound are required to obtain the desired improved hydrolytic stability. Generally the composition of the invention will contain an amount of triazole compound which will provide an additive concentrate for lubricants and functional fluid which contains as little as 50 ppm of the triazole and preferably less than 20 ppm of the triazole. When formulated into finished lubricants and functional fluids, the compositions of the invention are prepared to provide the lubricant or functional fluid with a stabilizing amount of the triazole which generally is less than 10 ppm, and may be less than 3 ppm of finished lubricant or functional fluid.

Components (A), (B) and (C) can be blended together in any suitable manner and then admixed, for example, with a diluent to form a concentrate as discussed below, or with a lubricant or functional fluid, as discussed below. Alternatively, components (A), (B) and (C) can be admixed separately with such diluent, lubricant or functional fluid. In preparing concentrates, it is preferred that the triazole be dissolved first in the diluent by heating to a temperature of about 80°–90° followed by cooling before the remaining components, including (A) and (B) are blended into the diluent. The blending technique for mixing the components is not critical and can be effected using any standard technique, depending upon the specific nature of the materials employed. In most instances, components (A) and (B) are liquids that are miscible with each other and, accordingly, can be readily mixed. In general, blending can be accomplished at room temperature. However, in instances wherein the viscosity of either component (A) or (B) is relatively high, blending can be facilitated by heating the components.

As previously indicated, the compositions of the present invention are useful as additives for lubricants and functional fluids, in which they function primarily as antioxidants and extreme pressure agents having improved thermal stability as compared with ordinary phosphorodithioic acid salts. They can be employed in a variety of lubricants based on diverse oils of lubricating viscosity, including natural and synthetic lubricating oils and mixtures thereof. The lubricants include crankcase lubricating oils for spark-ignited and compression-ignited internal combustion engines, including automobile and truck engines, two-cycle engines, aviation piston engines, marine and railroad diesel engines, and the like. Also contemplated are lubricants for gas engines, stationary power engines and turbines and the like. Transaxle lubricants, gear lubricants, metal-working lubricants and other lubricating oil and grease compositions, as well as functional fluids such as hydraulic fluids and automatic transmission fluids, benefit from the incorporation therein of the compositions of the present invention.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale oil can also be included as the base oil. Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di(2-ethylhexyl)benzenes, etc.); polyphenyls (e.g., biphenyls, terphenyls, alkylated polyphenyls, etc.); alkylated diphenyl ethers and alkylated diphenyl and sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another class of synthetic oils (e.g., tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa(4-methyl-2-pentoxy)-disiloxane, poly(methyl) siloxanes, poly(methylphenyl)siloxanes, etc.). Other synthetic oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used in the lubricants and functional fluids of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Generally, the lubricants and functional fluids of the present invention contain an amount of the compositions of this invention sufficient to provide it with antioxidant and improved extreme pressure properties. Normally this amount will be about 0.25% to about 10%, preferably about 0.4% to about 7.5%, of the total weight of the fluid. As mentioned above, the compositions of the invention, by virtue of the presence of the triazole compound, provide functional fluids having improved hydrolytic stability. This improved hydrolytic stability is observed in functional fluids prepared with the compositions of the invention wherein the functional fluids contain as little as 3 ppm or less of the triazole.

The invention also contemplates the use of other additives in combination with the compositions of this invention. Such additives include, for example, detergents and dispersants of the ash-producing or ashless type, corrosion- and auxiliary oxidation-inhibiting agents, pour point depressing agents, auxiliary extreme pressure agents, color stabilizers and anti-foam agents.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature above 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen-containing compounds such as amine, organic hydroxy compounds such as phenols and alcohols, and/or basic inorganic materials. Examples of these "carboxylic dispersants" are described in British Pat. No. 1,306,529 and in many U.S. patents including the following:

| | | |
|---|---|---|
| 3,163,603 | 3,351,552 | 3,541,012 |
| 3,184,474 | 3,381,022 | 3,542,678 |
| 3,215,707 | 3,399,141 | 3,542,680 |
| 3,219,666 | 3,415,750 | 3,567,637 |
| 3,271,310 | 3,433,744 | 3,574,101 |
| 3,272,746 | 3,444,170 | 3,576,743 |
| 3,281,357 | 3,448,048 | 3,630,904 |
| 3,306,908 | 3,448,049 | 3,632,510 |
| 3,311,558 | 3,451,933 | 3,632,511 |
| 3,316,177 | 3,454,607 | 3,697,428 |
| 3,340,281 | 3,467,668 | 3,725,441 |
| 3,341,542 | 3,501,405 | Re 26,433 |
| 3,346,493 | 3,522,179 | |

(2) Reaction products of relatively high molecular weight aliphatic or alicyclic halides with amines, preferably polyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. patents are illustrative:

| | |
|---|---|
| 3,413,347 | 3,725,480 |
| 3,697,574 | 3,726,882 |
| 3,725,277 | |

(4) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,524,025 | 3,373,111 | 3,539,633 | 3,697,574 |
| 3,526,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

Auxiliary extreme pressure agents and corrosion- and auxiliary oxidation-inhibiting agents are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, poly-propylene (molecular weight 500)-substituted phenyl phosphite, diisobutyl-substituted phenyl phosphite; metal thiocarbamates, such as zinc dioctyldithiocarbamate and barium heptylphenyl dithiocarbamate; and phenolic compounds such as 2,6-di-tert-butyl phenol and 2,6-di-tert-butyl-4-methyl phenol.

The compositions of this invention can be added directly to the lubricant. Often, however, they are preferably diluted with a substantially inert, normally liquid organic diluent such as mineral oil, naphtha, benzene, toluene or xylene, to form an additive concentrate. These concentrates usually contain from about 20% to about 90% by weight of the composition of this invention and may contain, in addition, one or more other additives known in the art or described hereinabove.

The following are exemplary hydraulic fluids in accordance with this invention.

| Ingredient | Parts by Weight A | Parts by Weight B |
|---|---|---|
| Mineral oil | 94.25 | 96.89 |
| Product of Example A-1 | 1.50 | — |
| Product of Example A-7 | — | 2.0 |
| Pentaerythritol ester of polybutenyl (mol. wt. about 1000) succinic acid, reacted with alkylene polyamine | 1.43 | — |
| Reaction product of alkylene polyamine with polybutenyl (mol. wt. about 1700) succinic anhydride containing more than one succinic group per polybutenyl group | 1.25 | — |
| Basic calcium petroleum sulfonate | 0.39 | 0.20 |
| Basic sulfurized calcium tetrapropenyl phenate | 1.18 | 0.40 |
| Polyoxyalkylene demulsifier | 0.001 | 0.001 |
| 2,6-di-tert-butyl phenol | — | 0.50 |
| Tolyltriazole | * | * |
| Silicone anti-foam agent | 0.01 | 0.01 |

*Present as 1 ppm of finished hydraulic fluid.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition comprising

A. at least one metal salt of a mixture of acids comprising (A)(I) at least one acid of Formula I

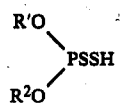

I wherein R′ and $R^2$ are the same or different and each of R′ and $R^2$ is a hydrocarbon-based group, and (A)(II) at least one aliphatic or alicyclic carboxylic acid containing from about 2 to about 40 carbon atoms;

B. at least one sulfurized Group II metal phenate; and

C. a stabilizing amount of at least one triazole selected from the group consisting of benzotriazole and alkyl substituted benzotriazoles containing up to 15 carbon atoms in the alkyl group.

2. The composition of claim 1 wherein the metal of component (A) is at least one of Group I metals, Group II metals, aluminum, tin, cobalt, lead, molybdenum, manganese and nickel.

3. The composition of claim 1 wherein each of R′ and $R^2$ is an alkyl group containing from about 3 to about 50 carbon atoms.

4. The composition of claim 1 wherein each of R′ and $R^2$ is a branched alkyl group.

5. The composition of claim 1 wherein the metal of component (A) is zinc.

6. The composition of claim 1 wherein component (A)(II) has the formula $R^3COOH$, wherein $R^3$ is an aliphatic or alicyclic hydrocarbon-based group.

7. The composition of claim 1 wherein component (A)(II) contains from about 2 to about 40 carbon atoms.

8. The composition of claim 6 wherein $R^3$ is a saturated aliphatic group.

9. The composition of claim 6 wherein $R^3$ is a branched alkyl group.

10. The composition of claim 6 wherein each of R′ and $R^2$ is 2-ethylhexyl and $R^3$ is 3-heptyl.

11. The composition of claim 1 wherein the ratio of equivalents of (A)(I) to (A)(II) is between about 0.5:1 and 500:1.

12. The composition of claim 1 wherein the ratio of equivalents of (A)(I) to (A)(II) is between about 0.5:1 and 100:1.

13. The composition of claim 1 wherein the weight ratio of (A) to (B) is in the range of about 40:1 to 1:2.

14. The composition of claim 1 wherein the metal salt of (A) is contacted under reaction conditions with at least one phosphite of the formula $(R^4O)_3P$ wherein each $R^4$ is hydrogen or a hydrocarbon-based group.

15. The composition of claim 14 wherein each $R^4$ is a hydrocarbon-based group.

16. The composition of claim 1 wherein component (B) includes at least one hydrocarbon-based group attached to an aromatic moiety, said hydrocarbon-based group having from about 6 to about 80 carbon atoms.

17. The composition of claim 16 wherein said hydrocarbon-based group has from about 6 to about 30 carbon atoms.

18. The composition of claim 16 wherein aromatic moiety is a benzene nucleus.

19. The composition of claim 1 wherein component (B) contains up to about 100% of the metal present in the corresponding sulfurized normal Group II metal phenate.

20. The composition of claim 1 wherein component (B) contains from about 250% to about 450% of the metal present in the corresponding sulfurized normal Group II metal phenate.

21. The composition of claim 1 wherein component (B) has a phenol group to sulfur mole ratio in the range of about 2:1 to about 1:2.

22. The composition of claim 14 wherein component (B) is a basic sulfurized calcium alkyl-substituted phenate.

23. The composition of claim 1 wherein (C) is tolyltriazole.

24. The composition of claim 1 containing less than 5% of the triazole.

25. The composition of claim 24 containing less than 1% of tolyltriazole.

26. The composition of claim 1 also containing a basic alkali or alkaline earth metal salt of an organic sulfonic acid.

27. The composition of claim 1 also containing a phenolic antioxidant compound.

28. The composition of claim 1 also containing at least one detergent.

29. The composition of claim 1 also containing at least one dispersant.

30. The composition of claim 1 also containing at least one anti-oxidant.

31. The composition of claim 1 also containing at least one emulsifier.

32. An additive concentrate comprising a substantially inert, normally liquid organic diluent and the composition of any one of claims 1–25, 26, 27 or 28–31.

33. A lubricant or functional fluid comprising a major amount of a lubricating oil and a minor amount of the composition of any one of claims 1–25, 26, 27 or 28–31.

* * * * *